United States Patent [19]

Graham

[11] Patent Number: 4,746,288

[45] Date of Patent: May 24, 1988

[54] COMPACT CARTRIDGE LIGHTER HAVING FUEL VAPORIZATION ELEMENT IN COMBINATION WITH LIQUID BARRIER FILTER

[76] Inventor: Walter O. Graham, 1073 Lime Ave., Long Beach, Calif. 90813

[21] Appl. No.: 851,964

[22] Filed: Apr. 14, 1986

[51] Int. Cl.[4] ..... F23D 14/28; F23Q 1/02

[52] U.S. Cl. ..... 431/344; 431/277

[58] Field of Search ..... 431/130, 131, 254, 273, 431/277, 344, 254

[56] References Cited

U.S. PATENT DOCUMENTS

| | | | |
|---|---|---|---|
| 3,096,636 | 7/1963 | Newman | 431/344 |
| 3,523,006 | 8/1970 | Piffath et al. | 431/277 |
| 4,042,316 | 8/1977 | Rabe | 431/344 |
| 4,177,646 | 12/1979 | Guadagnin et al. | 431/344 |
| 4,235,589 | 11/1980 | Vallera | 431/344 |

FOREIGN PATENT DOCUMENTS

| | | | |
|---|---|---|---|
| 2442404 | 7/1980 | France | 431/344 |

*Primary Examiner*—Margaret A. Focarino

*Attorney, Agent, or Firm*—Bogucki, Scherlacher, Mok & Roth

[57] ABSTRACT

A gas lighter of compact size and of elongated cylindrical configuration has a head assembly joined to a disposable fuel cartridge. The head assembly includes an aluminum fuel vaporization element located immediately above and in communication with the interior of the fuel cartridge via a tapered lower portion of the element which penetrates a thin wall at the upper end of the fuel cartridge when the element of the head assembly is screwed into the fuel cartridge. The aluminum fuel vaporization element heats in response to vaporization and the resulting expanding movement therethrough of pressurized liquid fuel in the fuel cartridge. This enhances the formation and passing of fuel vapors through a filter consisting of a compressed stack of paper disks disposed within a hollow upper end of the aluminum fuel vaporization element to a valve mounted thereabove. At the same time the filter acts as a barrier to liquid fuel. Manual opening of the valve in conjunction with rotation of a wheel at the top of a spark assembly which generates a spark to ignite the gas provides for the flow of gaseous fuel through the valve to sustain the flame.

14 Claims, 1 Drawing Sheet

COMPACT CARTRIDGE LIGHTER HAVING FUEL VAPORIZATION ELEMENT IN COMBINATION WITH LIQUID BARRIER FILTER

BACKGROUND OF THE INVENTION

1. Field of the Invention

The present invention relates to lighters, and more particularly to disposable fuel cartridge lighters of the type in which liquid fuel stored under pressure in a fuel cartridge is vaporized in controlled fashion to provide the fuel in gaseous form to a flame ignited by a spark assembly.

2. History of the Prior Art

One common and well known lighter design vaporizes fuel such as butane stored in a pressurized liquid form so as to feed and thereby sustain a flame provided by a spark assembly. The vaporized fuel is fed to the flame in gaseous form through a burner valve having a switch which is manually actuated to hold the valve open and thereby sustain the flame. Upon release of the switch, the valve is closed to shut off the gas flow and terminate the flame.

Lighters of the type described employ various different arrangements of parts for vaporizing the pressurized liquid fuel and providing it to the burner valve in controlled fashion. Elongated elements such as hollow tubes and wicks are commonly provided within a container for the pressurized liquid butane so as to provide a vehicle for vaporization of the butane as it exits the container. Such elongated elements are often provided in combination with other elements which enhance the vaporization of the fuel and the formation of gas therefrom. Such other elements include metallic elements made of aluminum or similar materials which heat in response to the passage of the expanding liquid butane or other fuel to thereby enhance the vaporization of the fuel. Other elements which are used in such lighters comprise filters of various shapes and configurations which are designed to act as barriers to prevent fuel in liquid form from passing to and clogging the burner valve while at the same time readily passing fuel in vaporous or gaseous form to the burner valve.

Conventional arrangements for vaporizing and gassifying the pressurized liquid butane or other fuel in lighters suffer from a number of disadvantages. One such disadvantage relates to the size of such apparatus. For example, where elongated tubes or sticks are employed to provide vaporization in conjunction with liquid filtering action, the resulting arrangement often requires that the lighter be of some nominal or minimum size which may be larger than desired. It is quite difficult, for example, to make a lighter of relatively compact size such as one no larger in diameter than the common pencil. This es especially true where it is desired to maintain the fuel compartment of the lighter free of tubes, cotton, foam rubber and other such objects.

Disposable cartridge lighters of relatively compact size would be highly advantageous, particularly if they could be mass produced at relatively low cost. Such lighters could not rely on the use of expensive filters.

Examples of conventional lighter arrangements are provided by U.S. Pat. No. 3,523,006 of Piffath et al, U.S. Pat. No. 2,892,251 of Felt, U.S. Pat. No. 3,286,491 of Smith, U.S. Pat. No. 4,235,589 of Vallera, U.S. Pat. No. 4,177,646 of Guadagnin et al, U.S. Pat. No. 4,008,992 of Johnsson, U.S. Pat. No. 3,589,851 of Rabe, U.S. Pat. No. 3,827,852 of Chevallier, U.S. Pat. No. 3,327,504 of Smith, U.S. Pat. No. 2,836,044 of Zellweger and U.S. Pat. No. 3,597,140 of Rabe.

U.S. Pat. No. 3,523,006 of Piffath et al provides an example of a lighter which is of sufficiently complicated and costly construction as to prevent manufacture thereof in compact sizes and with sufficient economy to allow for disposal after only limited usage. Instead, the complex arrangement of Piffath et al is designed for prolonged use in conjunction with a dispensable fuel cartridge. An arrangement including a pair of rubber disks, a paper disk and a cloth disk acts as a pressure regulator for regulating the pressure of vaporized fuel. Cotton or foam rubber is placed in the fuel cartridge to enhance vaporization of the fuel. Gas entering an opening is forced to flow radially outwardly through a paper disk, around the outside of an imperforate disk and then radially inwardly through a cloth disk to an opening in another disk.

Various other ones of the above-noted patents utilize apparatus which includes different filter arrangements for passing fuel in vaporous or gaseous form to the exclusion of fuel in liquid form. Such arrangements tend to be of complex and in many cases expensive configuration, and often do not provide the degree of filtering action that is needed. U.S. Pat. No. 2,892,251 of Felt utilizes a pellet of compressed granular or powdered material. U.S. Pat. No. 3,286,491 of Smith utilizes a filter made of pressed and sintered granules of plastic or metallic oxide. The arrangement of U.S. Pat. No. 4,235,589 of Vallera uses a sintered metal element, as does U.S. Pat. No. 4,177,646 of Guadaguin. U.S. Pat. No. 4,008,992 of Johnsson utilizes a rubber plate. U.S. Pat. No. 3,327,504 of Smith utilizes a sintered material which may be sintered metal, sintered plastic, sintered ceramic or other materials. All of these materials and configurations increase production costs.

Accordingly it is an object of the invention to provide an improved compact and economical lighter, preferably one that can be made with sufficient economy so as to be disposable after limited usage.

It is a further and more specific object of the invention to provide a compact and economical arrangement for converting liquid fuel under pressure into vapors in a controlled manner and while at the same time filtering the liquid fuel.

It is a still further object of the invention to provide an improved fuel vaporizing element of compact configuration which provides for vaporization of the liquid fuel by heating in response to passage of the expanding fuel so as to enhance the vaporization of the fuel.

It is a still further object of the invention to provide a filter of improved and economical design for freely and readily passing vapors and gases of the fuel to the exclusion of liquid fuel and for reducing the pressure of the vapors and gases to control the flow of the gases to the burner valve.

BRIEF DESCRIPTION OF THE INVENTION

These and other objects are accomplished in accordance with the invention by providing a lighter with a fuel vaporization element of advantageous design in combination with a filter of advantageous design. The lighter is comprised of a head assembly removably coupled to a disposable fuel cartridge. The fuel vaporization element is located at the end of the head assembly and is disposed at one end of the fuel cartridge containing liquid butane or other liquid fuel maintained under high pressure. The fuel vaporization element which communicates with the inside of a container for the fuel within the fuel cartridge heats in response to movement of expanding gaseous fuel therethrough as the liquid fuel vaporizes. Heating of the fuel vaporization element enhances the expansion and gassification of the fuel. The filter which is located between the fuel vaporization element and a valve within the head assembly acts as a barrier to liquid fuel to insure that no fuel in liquid form is passed to the valve. At the same time, the filter passes fuel in vaporous or gaseous form to the valve. The expanding fuel vapors continue to generate heat which continues to promote expansion and gassification of the fuel. The valve is controlled in conventional fashion in conjunction with a spark assembly. Operation of the spark assembly generates a spark which ignites the expanding flow of gaseous fuel from the filter which is passed by the valve. A switch associated with the valve is manually actuated so as to hold the valve open as long as the flame is desired.

The fuel vaporization element in combination with the filter enables the lighter to be made in a compact and economical form. The lighter can readily be made in small sizes in an economical manner. The need for elongated hollow tubes, wicks, cotton or foam rubber elements or other objects within the fuel container is eliminated.

In a specific embodiment of a lighter in accordance with the invention, the lighter is of elongated, generally cylindrical configuration and includes a cartridge providing a fuel container at the lower end thereof, an intermediate jacket removably joined to the cartridge and an upper collar. The intermediate jacket and the upper collar together comprise a head assembly. The fuel container which is of generally cylindrical shape stores a quantity of liquid butane or other appropriate fuel therein under pressure. A threaded fitting at the upper end of the fuel container communicates with the hollow interior of the container through an aperture created therein by penetration of the fuel vaporization element when the head assembly is screwed into the fuel cartridge to attach the fuel cartridge thereto. The fuel vaporization element partly resides within a lower portion of the jacket and has a threaded portion thereof received by the threaded fitting at the upper end of the fuel cartridge. The fuel vaporization element has a tapered nozzle which extends downwardly from the threaded portion thereof within the threaded fitting at the upper end of the fuel cartridge and penetrates a thin wall in the upper end of the fuel cartridge so that a central passage within the fuel vaporization element is able to communicate with the interior of the fuel cartridge. The central passage extends through an end wall within the fuel vaporization element to the interior of a hollow, generally cylindrical portion in which the filter is contained.

The fuel vaporization element provides for the formation and passage of fuel vapors through the central passage thereof to the filter. The fuel vaporization element is preferably made of aluminum or other appropriate material which heats in response to the movement of the vaporizing and expanding pressurized fuel. The heating action enhances vaporization and transfer into a gaseous state of the liquid fuel.

The filter which is of economical construction acts as a barrier to liquid fuel while at the same time freely passing vaporized fuel to a valve located above the filter. The filter is a mass of essentially paper composition, and preferably comprises a compressed stack of paper disks of generally cylindrical form. Such an arrangement which is of relatively simple and economical construction has been found effective in providing the necessary barrier to liquid fuel while at the same time freely passing fuel in vaporized or gaseous form.

The hollow, generally cylindrical portion of the fuel vaporization element which contains the filter resides within a hollow, generally cylindrical cavity in a lower end of the jacket. The jacket has an interior wall with an aperture extending therethrough between the hollow, generally cylindrical cavity and a third cavity extending into the jacket from an opposite upper end thereof. Fuel gases passed by the filter flow through the aperture to a valve mounted within the third cavity. The jacket also has a second cavity in the upper end thereof in which a spark assembly is mounted.

The collar which is of hollow, generally cylindrical configuration fits over the upper end of the jacket so as to surround the valve and most of the spark assembly except for a flint wheel which is disposed outside of the collar. A manually operable valve switch extends through an aperture in the side of the collar and couples to the valve within the collar. Manual rotation of the flint wheel causes the spark assembly to create sparks. At the same time, the valve switch is manually depressed so as to open the valve and permit gaseous fuel coming up from the filter to flow through the valve and into the region of the flint wheel where the gas flow is ignited by the generated sparks to provide the desired flame. Continued manual depression of the valve switch maintains the gas flow through the valve and thereby the flame. When it is desired to terminate the flame, the valve switch is released to close the valve and shut off the flow of gaseous fuel.

BRIEF DESCRIPTION OF THE DRAWINGS

The foregoing and other objects, features and advantages of the invention will be apparent from the following more particular description of a preferred embodiment of the invention, as illustrated in the accompanying drawings, in which.

DETAILED DESCRIPTION

Figure 1:
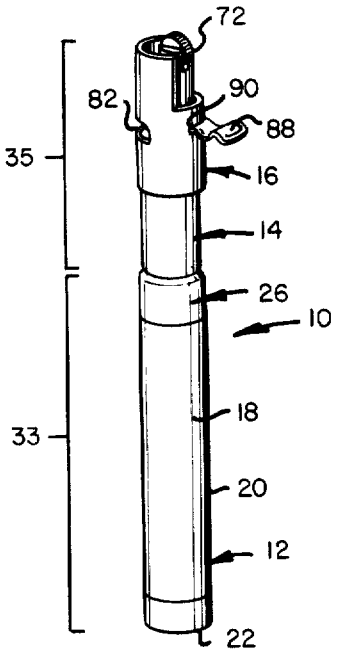
FIG. 1 is a perspective view of a lighter in accordance with the invention.
Figure 2:
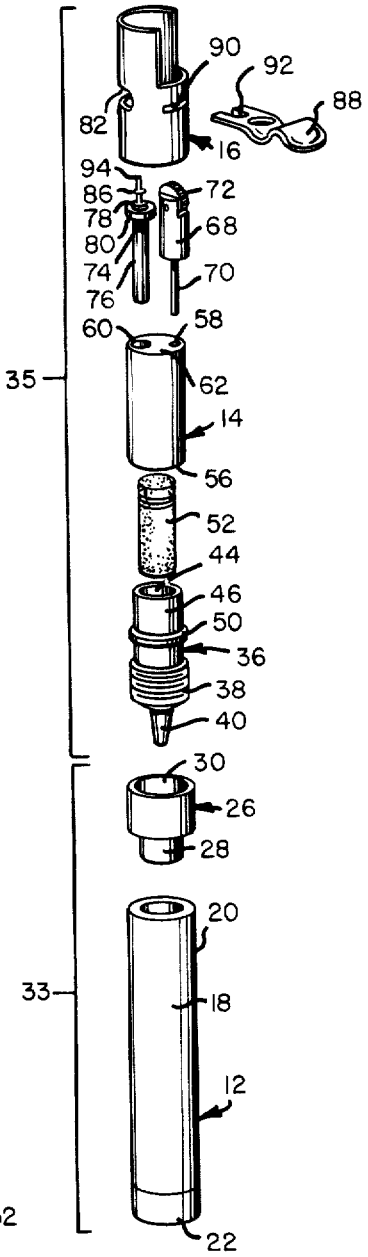
FIG. 2 is an exploded perspective view of the lighter of FIG. 1.
Figure 3:
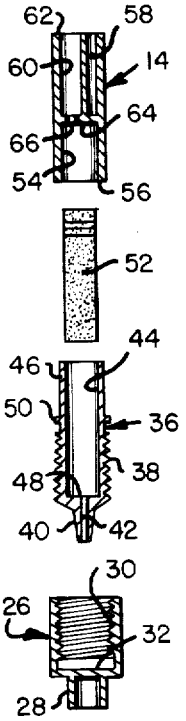
FIG. 3 is an exploded sectional view of several of the component parts of the lighter of FIG. 1.

FIGS. 1–5 depict a lighter 10 in accordance with the invention. The lighter 10 which is of elongated, generally cylindrical configuration includes a fuel container 12 at the lower end thereof, a jacket 14 at an intermediate portion thereof and a collar 16 at the upper end thereof. As seen in FIG. 1 the fuel container 12, the jacket 14 and the collar 16 are each of generally cylindrical configuration.

The fuel container 12 is hollow and contains a quantity of liquid butane 18 or other appropriate fuel under high pressure. The pressure is at a level which produces the necessary vaporization of the liquid butane as described hereafter, and is typically on the order of about 50 psi. In the present example the fuel container 12 is comprised of a hollow transparent plastic tube 20 having a rubber plug 22 inserted so as to seal off the lower end thereof. The transparent plastic tube 20 allows for viewing of the level of the liquid butane 18 so that the amount of fuel remaining in the lighter 10 can be determined.

A threaded fitting 26 which is of generally cylindrical configuration has a lower portion 28 thereof inserted within the open upper end of the plastic tube 20 to complete the fuel container 12. The threaded fitting 26 which is shown in detail in FIGS. 2–4 as well as in FIG. 1 has a threaded interior 30 and an interior wall 32 disposed between the threaded interior 30 and the lower portion 28.

The fuel container 12 and the threaded fitting 26 together comprise a fuel cartridge 33. The jacket 14 and the collar 16 together comprise a head assembly 35. As described hereafter the fuel cartridge 33 which is joined to the lower end of the head assembly 35 is removable therefrom so that the head assembly 35 can be reused with a new fuel cartridge when fuel in the old fuel cartridge is depleted. Alternatively, the fuel cartridge 33 may be permanently joined to the head assembly 35. In that event the entire lighter 10 is discarded when the fuel is depleted, unless the fuel cartridge 33 is made refillable. The fuel cartridge may be made refillable by replacing the plug 22 at the lower end of the fuel container 12 with a refilling valve. Using the refilling valve the fuel cartridge 33 can be refilled each time the fuel therein is depleted.

A fuel vaporization element 36 which is located at the bottom of the head assembly 35 has a treaded intermediate portion 38 thereof which is received by the threaded interior 30 of the threaded fitting 26 when the fuel cartridge 33 is installed on the head assembly 35. The fuel vaporization element 36 has a tapered lower portion 40 extending downwardly from the threaded intermediate portion 38 thereof and having a passage 42 of relatively small diameter extending therethrough. When the fuel vaporization element 36 is screwed into place within the threaded fitting 26 of the fuel cartridge 33, the tapered lower portion 40 penetrates through the interior wall 32 which serves as a seal for the pressurized liquid butane 18 until the fuel cartridge 33 is installed on the head assembly 35. This action produces a hole 43 in the interior wall 32 through which the tapered lower portion 40 extends. This enables the passage 42 within the tapered lower portion 40 to communicate with the liquid butane 18 within the plastic tube 20. The pressure of the liquid butane 18 within the plastic tube 20 causes vapors of the butane 18 to form within the passage 42 and to flow upwardly through the passage 42 to an interior cavity 44 formed within a hollow, generally cylindrical portion 46 of the fuel vaporization element 36 at the upper end thereof above the threaded intermediate portion 38. The interior cavity 44 terminates at an end wall 48 thereof where the tapered lower portion 40 and its included passage 42 begin. The exterior of the hollow, generally cylindrical portion 46 of the fuel vaporization element 36 is provided with a ring-shaped flange 50 against which the jacket 14 is seated. A filter 52 of generally cylindrical shape is disposed within the interior cavity 44 of the fuel vaporization element 36.

The jacket 14 which is of generally cylindrical configuration has a generally cylindrical cavity 54 in a lower end 56 thereof for receiving the hollow, generally cylindrical portion 46 of the fuel vaporization element 36. The hollow, generally cylindrical portion 46 of the fuel vaporization element 36 is inserted into the cylindrical cavity 54 of the jacket 14 until the lower end 56 of the jacket 14 resides against the ring-shaped flange 50. The jacket 14 also has a second generally cylindrical cavity 58 therein and a third generally cylindrical cavity 60 therein. The second and third cylindrical cavities 58 and 60 extend into the jacket 14 from an upper end 62 of the jacket 14 opposite the lower end 56. An interior wall 64 in the jacket 14 is disposed between the cylindrical cavity 54 extending into the jacket 14 from the lower end 56 and the second and third cylindrical cavities 58 and 60 extending into the jacket 14 from the upper end 62. The interior wall 64 is provided with a small aperture 66 therein which extends through the wall 64 between the cylindrical cavity 54 and the third cylindrical cavity 60.

A spark assembly 68 is mounted within the second cylindrical cavity 58 in the jacket 14. The spark assembly 68 which is of conventional design includes a hollow tube 70 which extends into the cylindrical cavity 58 and a flint wheel 72 rotatably mounted at an upper end of the spark assembly 68. A spring (not shown) within the hollow tube 70 exerts an upward force against a length of flint (not shown) which is also contained within the hollow tube 70, thereby forcing the length of flint against the flint wheel 72. When the flint wheel 70 is rotated manually by the users thumb, it rubs against the length of flint within the hollow tube 70 so as to generate sparks in conventional fashion.

A burner valve 74 of conventional design has a hollow tube 76 at a lower portion thereof which is mounted within the third cylindrical cavity 60. The hollow tube 76 which is disposed directly over the aperture 66 in the interior wall 64 of the jacket 14 permits fuel gases from the filter 52 which pass through the aperture 66 to rise to an upper part 78 of the valve 74. The upper part 78 includes an adjustment wheel 80 which is accessible by means of an opening 82 in the side of the collar 16. Manually rotating the adjustment wheel 80 of the valve 74 adjusts the volume of fuel gases passed by the valve 74 when the valve 74 is in the open position.

The burner valve 74 is opened by raising a disk 86 via a valve switch 88. The valve switch 88 which extends through an aperture 90 in the side of the collar 16 has a recess 92 therein for receiving a stem 94 of the valve 74 on which the disk 86 is mounted. Manually moving the portion of the valve switch 88 which extends outside of the collar 16 in a downward direction causes the valve switch 88 to pivot within the aperture 90 so as to raise the disk 86 and the attached stem 94 to open the valve 74 and thereby permit fuel gases to flow through the valve 74. When the valve switch 88 is manually released, a spring (not shown) within the valve 74 pulls the stem 94 and the included disk 86 downwardly to close the valve 74 and cut off the flow of fuel gases.

Accordingly, when the flint wheel 72 is rotated by the users thumb, the flint wheel 72 rubs against the length of flint (not shown) within the hollow tube 70 to generate sparks in the region above the valve 74. Immediately following rotation of the flint wheel 72, the users thumb comes to rest on the valve switch 88 so as to pivot the valve switch 88 and raise the disk 86 on the stem 94 of the valve 74. This opens the valve 74, allowing fuel gases to flow upwardly therethrough. The fuel gases are ignited by the sparks generated by rotation of the flint wheel 72 to create the desired flame. The flame continues to burn so long as the valve switch 88 is held down by the users thumb so as to hold the valve 74 open. Upon release of the valve switch 88, the spring action of the valve 74 closes the valve 74 to cut off the flow of fuel gas.

Figure 4:
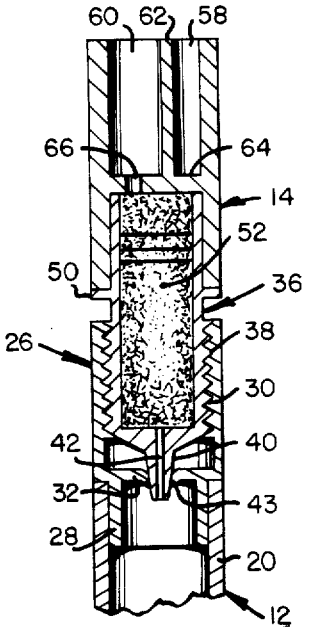
FIG. 4 is a sectional view of the component parts of FIG. 3 in an assembled position.

As perhaps best seen in FIG. 4 the tapered lower portion 40 of the fuel vaporization element 36 and its included passage 42 reside just above the hollow interior of the plastic tube 20 comprising the fuel container 12 within the fuel cartridge 33. This enables the passage 42 within the tapered lower portion 40 to communicate directly with the liquid butane 18 inside the plastic tube 20 of the fuel container 12. In this manner fuel vapors are formed within and pass upwardly through the passage 42 to the filter 52 within the interior cavity 44 at the upper portion of the fuel vaporization element 36. The shape and the aluminum construction of the fuel vaporization element 36 cause the element 36 to heat in response to movement of the expanding fuel vapors therethrough, and this enhances the formation of and the upward flow of the fuel gases.

Figure 5:
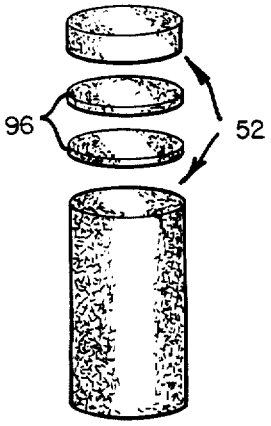
FIG. 5 is an exploded perspective view of the filter of the lighter of FIG. 1.

The location of the filter 52 just above the passage 42 in the tapered lower portion 40 of the fuel vaporization element 36 at a relatively short distance from the interior of the plastic tube 20 of the fuel container 12 enables the filter 52 to act as a barrier to liquid fuel while at the same time freely passing fuel in vaporized or gaseous form to the valve 74 via the aperture 66. The filter 52 which is shown in detail in FIG. 5 is of relatively simple and low cost construction and consists of a compressed stack of paper disks 96. The paper disks 96 can be made from virtually any grade and quality of paper including the relatively porous and inexpensive newspaper stock. Compression of a stack of the paper disks 96 by a sufficient amount provides a filter 52 which is capable of the necessary filtering action. Such resulting filter 52 is of relatively low porosity when compared with filter material such as compressed wood, sintered metals and plastics, and thereby provides the desired liquid barrier. At the same time the relatively low porosity paper filter 52 has been found to readily pass fuel vapors and gases therethrough.

While the invention has been particularly shown and described with reference to a preferred embodiment thereof, it will be understood by those skilled in the art that various changes in form and details may be made therein without departing from the spirit and scope of the invention.

I claim:

1. A lighter comprising the combination of a fuel container for storing a liquid fuel therein, a fuel vaporization element having an interior cavity with an end wall and an elongated nozzle extending from the end wall, the fuel vaporization element being located outside of and communicating with the fuel container via the elongated nozzle thereof extending into the fuel container from outside of the fuel container, the fuel vaporization element having a passage therein extending through the nozzle thereof from the end wall and providing for the formation and passage of fuel vapors therethrough from the liquid fuel in the fuel container, a valve, a spark assembly disposed adjacent the valve, and a filter disposed within the interior cavity of the fuel vaporization element between the passage in the nozzle of the fuel vaporization element and the valve, the filter being disposed in contact with the nozzle of the fuel vaporization element at the passage and forming a barrier to liquid fuel while passing vaporized fuel therethrough to the valve.

2. The invention set forth in claim 1, wherein the fuel vaporization element, the valve, the spark assembly and the filter together comprise a head assembly, the fuel vaporization element has a threaded portion adjacent the elongated nozzle thereof, the elongated nozzle is of tapered configuration, and the fuel container has a relatively thin wall and a threaded portion adjacent the relatively thin wall and forms a part of a fuel cartridge which is releasably coupled to the head assembly by engagement of the threaded portion thereof with the threaded portion of the fuel vaporization element, the elongated nozzle of the fuel vaporization element penetrating the relatively thin wall of the fuel container when the fuel cartridge is releasably coupled to the head assembly.

3. The invention set forth in claim 1, wherein the fuel vaporization element is comprised of material which heats in response to movement of vaporizing liquid fuel stored under high pressure in the fuel container to enhance vaporization of liquid fuel from the fuel container and passage thereof through the fuel vaporization element and the filter.

4. The invention set forth in claim 3, wherein the fuel vaporization element is made of aluminum.

5. The invention set forth in claim 1, wherein the filter consists essentially of a mass of paper.

6. The invention as set forth in claim 1, wherein the fuel vaporization element has a hollow, generally cylindrical portion having the interior cavity with the end wall therein.

7. A lighter comprising the combination of a fuel container for storing a liquid fuel therein, a fuel vaporization element located outside of and communicating with the fuel container, the fuel vaporization element having a passage therein and providing for the formation and passage of fuel vapors therethrough from liquid fuel in the fuel container, a valve, a spark assembly disposed adjacent the valve, a filter disposed between the passage in the fuel vaporization element and the valve, the filter forming a barrier to liquid fuel while passing vaporized fuel therethrough to the valve, the fuel vaporization element having a hollow, generally cylindrical portion for receiving at least a portion of the filter therein, the hollow, generally cylindrical portion having an end wall, and a tapered nozzle portion extending from the end wall and having a central passage therein which extends therethrough and through the end wall to the hollow interior of the generally cylindrical portion, a generally cylindrical jacket having a hollow, generally cylindrical cavity in a first end thereof communicating with an interior wall of the jacket and adapted to receive the hollow, generally cylindrical portion of the fuel vaporization element therein, a second cavity in a second end thereof opposite the first end and adapted to mount a spark assembly therein and a third cavity in the second end and communicating with the interior wall, the third cavity being adapted to mount the valve therein and the interior wall having an aperture therein extending between the third cavity and the hollow, generally cylindrical cavity.

8. A lighter having an elongated, generally cylindrical frame comprised of a lower, generally cylindrical fuel cartridge, an intermediate, generally cylindrical jacket, and an upper, generally cylindrical collar, the jacket and the collar together comprising a head assembly, the fuel cartridge having a fitting at an upper end thereof which is threaded, a fuel vaporization element within the jacket having a threaded exterior portion received by the threaded fitting to releasably couple the fuel cartridge to the head assembly and having a hollow, generally cylindrical upper end and a nozzle at a lower end thereof disposed within the fitting, the nozzle having a central aperture therein communicating with the hollow, generally cylindrical upper end, the jacket having a hollow, generally cylindrical cavity therein at a lower end thereof which receives the hollow, generally cylindrical upper end of the fuel vaporization element therein, a second cavity in an opposite upper end thereof and a third cavity in the opposite upper end thereof, the jacket having an aperture therein extending between the hollow, generally cylindrical cavity therein and the third cavity therein, a filter disposed within the hollow, generally cylindrical upper end of the fuel vaporization element, the collar being hollow, having an aperture in a side thereof and receiving the upper end of the jacket within a lower end thereof, a spark assembly mounted within the second cavity in the upper end of the jacket and extending upwardly through the collar and terminating in a flint wheel disposed outside of the collar, a valve mounted within the third cavity in the upper end of the jacket and a valve switch coupled to the valve and extending through the aperture in the side of the collar to the outside of the collar.

9. The invention set forth in claim 8, wherein the fuel vaporization element is made of aluminum and the filter is made of paper.

10. The invention set forth in claim 8, wherein the fitting has an interior wall therein which is penetrated by the nozzle of the fuel vaporization element upon coupling of the fuel cartridge to the head assembly.

11. For use in a lighter having a fuel container and a valve, a fuel vaporization element having an interior cavity with an end wall and an elongated nozzle portion extending from the end wall, the fuel vaporization element being disposed substantially completely outside of and communicating with the fuel container via a passage therein which extends through the nozzle portion of the fuel vaporization element from the end wall, the nozzle portion of the fuel vaporization element having an outer tip thereof disposed within the fuel container, and a filter disposed within the interior cavity of the fuel vaporization element between the passage in the fuel vaporization element and the valve, the filter being operative to pass fuel vapors which flow through the passage in the fuel vaporization element from the fuel container to the valve while at the same time acting as a barrier to liquid fuel from the fuel container.

12. The invention set forth in claim 11, wherein the fuel vaporization element is made of aluminum and the filter is made of paper.

13. A lighter comprising the combination of a sealed cartridge containing a quantity of liquid fuel and having a threaded element at one end thereof, a head assembly having an externally threaded fuel vaporization element for reception within the cartridge, a burner valve, and a spark assembly, the fuel vaporization element having an interior cavity with an end wall and an elongated nozzle portion extending from the end wall and having a passage therein extending through the nozzle portion from the end wall, the nozzle portion having an end thereof adapted to pierce the cartridge upon engagement and turning of the fuel vaporization element relative to the threaded element of the cartridge, a filter mounted partially in the interior cavity of the fuel vaporization element and being comprised of compressed, stacked paper disks, the filter extending from the fuel vaporization element to a region adjacent the burner valve and the spark assembly.

14. The invention set forth in claim 13, further including a jacket assembly having the burner valve and the spark assembly mounted therein, the jacket assembly being coupled to the fuel vaporization element of the head assembly to define together with the interior cavity of the fuel vaporization element a recess of fixed dimension therebetween in which the filter is mounted.

* * * * *